US005989042A

United States Patent [19]

Johnson et al.

[11] Patent Number: 5,989,042

[45] Date of Patent: Nov. 23, 1999

[54] ELECTRICAL CONNECTOR FOR USE BETWEEN SHIELDED MEDIA CONNECTORS AND COMPUTER COMMUNICATIONS CARDS

[75] Inventors: Thomas A. Johnson, Draper; Troy Garside, West Bountiful, both of Utah

[73] Assignee: 23-3178, Santa Clara, Calif.

[21] Appl. No.: 09/054,652

[22] Filed: Apr. 3, 1998

[51] Int. Cl.[6] ..... H01R 13/44; H01R 23/02

[52] U.S. Cl. ..... 439/131

[58] Field of Search ..... 439/131, 55, 78, 439/83, 329, 660, 676

[56] References Cited

U.S. PATENT DOCUMENTS 5,183,404 2/1993 Aldous et al. ..... 439/55

5,816,832 10/1998 Aldous et al. ..... 439/131

*Primary Examiner*—Steven L. Stephan

*Assistant Examiner*—Eugene G. Byrd

*Attorney, Agent, or Firm*—Workman, Nydegger & Seeley

[57] ABSTRACT

An improved electrical connector for use in a communications card for interfacing between a shielded media connector and a downsized computer is provided. In a preferred embodiment, the communications card comprises a retractable access portion and a fixed portion. The retractable access portion has an aperture formed therein configured to receive the shielded media connector. A conductive pin block provides electrical continuity between the shielded media connector and the fixed portion. A conductive shielding terminal encounters the shielding jacket on the shielded media connector and provides the shielding path through a distal end encountering a ground path contact such as the conductive cover of a PCMCIA communications card. The conductive shielding terminal additionally employs a spring tab extending into the aperture of the retractable access portion for positive contact with the shielded media connector.

27 Claims, 3 Drawing Sheets

ELECTRICAL CONNECTOR FOR USE BETWEEN SHIELDED MEDIA CONNECTORS AND COMPUTER COMMUNICATIONS CARDS

BACKGROUND OF THE INVENTION

1. The Field of the Invention

The present invention relates generally to the interface between physical/electrical media connectors and a communications card in a computer system. More specifically the present invention relates to an improvement in the electrical connection therebetween.

2. The Relevant Technology

The field of transmission of data by phone lines or network cables is a rapidly expanding field. Users of personal computers in particular are finding such practice to be of great value. For example, there are numerous public and private networks and databases which store data or programs. Absent the ability to send and receive data over telephone lines through a modem, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone or network line may dramatically increase productivity and reduce overall production time.

To translate the binary code utilized by a computer into signals capable of being transmitted over the telephone or network lines, modems have been developed to translate and reconfigure binary signals into analog signals capable of propagation over telephone or network lines. For conversion of signals to take place, a modem must be placed between the computer generating the binary signals and the communication line capable of carrying the analog signals.

Typically, in today's practice, a modem at the transmitting computer end of a communication line receives binary digital data from the computer and converts the binary code received from the computer into modem frequency signals. These modem frequency signals are then transmitted over the communication lines to a receiving modem at the receiving computer.

The modem at the recipient's end then converts the modem frequency signal back to binary digital data characters and inputs the data characters to the input port of the receiving computer.

As today's modems serve to provide a compatible interface between the communication lines and the computer, the Federal Communications Commission ("FCC") and telephone companies require an interface to moderate all signals or energy being input into the phone lines. This interface protects the phone lines and systems from damage, thereby ensuring the integrity and quality of transmissions over the phone lines.

A required part of this interface is a Data Access Arrangement ("DAA") circuit. The DAA circuit provides an impedance match and also serves to isolate the modem and the computer from transient signals and other disturbances coming in over the phone line. The DAA also protects the phone line from disabling influences emanating from the computer or the modem.

For example, damage would occur to the telephone system if instead of transmitting frequency signals, DC power was transmitted over the phone lines. Because the modem is attached directly to the phone line, the modem must incorporate the required FCC interface and must comply with any requirements imposed by local telephone companies.

The ubiquity of the telephone and the need for interactive systems throughout the world have caused standards to be established for the components of a telephonic system. Standardization allows telephone systems and devices using those systems to be interchangeable. The components of the telephone that are most thoroughly standardized are physical/electrical media connectors.

Physical/electrical media connectors are used by almost all telephone and communication companies throughout the world for many applications, the most important of which are interconnection of telephones with telephone lines and networks with network lines. For this reason, stringent standardization of connectors is required if compatibility and interactivity is to be realized.

One popular physical/electrical media connector used in the United States of America is the RJ-11 6-position miniature modular plug physical/electrical media connector. The RJ-11 is used between the telephone line and the telephone itself. Another important standard is the RJ-45 8-position miniature modular plug physical/electrical media connector. The RJ-45 is used primarily for network connectivity.

In contradistinction to the development of telephone lines, transmission or communication lines used in LANs have been developed specifically for the transmission of computer generated signals. Because of the recent development of these transmission lines, a variety of internal configurations for transmission lines have been developed to accomplish the transmission of computer data between computers.

A typical local area network comprises several computers at remote locations throughout a building interconnected with shielded and unshielded twisted pair cable utilizing RJ-type physical/electrical media connectors. The network is typically connected to a file server. A file server is a computer providing shared access to a file system, printer, electronic mail service, or modem. The file server is a combination of hardware and software that contains files shared by everyone connected to the LAN.

As LANs utilizing shielded and unshielded twisted pair cable are capable of transmitting signals at a higher rate than signals traveling through telephone lines, the requirements of the devices used to translate and reconfigure signals from the computer for transmission through lines have consequently been developed with different requirements.

The counterpart to the modem in telephonic communications is the LAN adapter card or data communications card. In a similar fashion to a modem, these communications cards reconfigure the parallel data produced by the computer into a serial form and back. These cards also provide buffering, encoding and decoding, cable access, and transmission.

As the use of LANs increases, it has become increasingly more beneficial for users of portable computers to have the ability to interact with several local area networks at different locations. For example, information at one location may be downloaded to a portable computer that allows a user to manipulate the data during a business trip and load the manipulated data onto the network at a destination. Diagnostics and maintenance are also made easier through the use of common connectors.

As the popularity of twisted-pair cable has increased, the popularity of the most frequently used physical/electrical media connector, the RJ-45 8-pin miniature modular plug, has also increased. This increase in popularity of the 8-pin miniature modular plug has introduced the same problems and solutions into LANs as will be discussed regarding the RJ-11 physical/electrical media connector in the development of modems.

Many modems in use today are configured as external accessory units, housed in their own cases, and attached to the computer. Typically, external modems are electrically connected to the telephone with a telephone extension line utilizing physical/electrical media connectors at each end. External modems are often employed by users of personal computers because they can easily contain a substantial amount of electronic circuitry or hardware, as well as executable programs or software.

With the advent of downsizing technology in computer components, however, smaller portable computers (often referred to as laptop or notebook computers) have taken the place of many of the desktop models which use external modems. With the new-found portability available with laptop or notebook computers, the size of external modems has proved cumbersome and been rendered obsolete in keeping with the portability that buyers of these downsized computers desire.

To overcome the inconvenience and physical limitations of external modems, smaller modems have been developed that are small enough to be built integrally within the housing of a portable computer. As a result, integral internal modems that interface with the ubiquitous RJ-11 and RJ-45 system provides users of portable computers with internal modems having a uniform standard interface for media access devices such as modems. Now, modem manufacturers can build products capable of accepting the RJ-11 and RJ-45 media connectors with confidence that their product can be used in a wide geographical area. Because modems can be built to the RJ-11 and RJ-45 uniform standards, consumers benefit from the ability to interchange and interconnect media access devices without the need for adapters for products made by different manufacturers.

As computer housings have continued to be downsized, internal spatial restrictions have required the establishment of standards for the internal accessories of the computer. One set of standards applicable to memory cards has been developed by the Personal Computer Memory Card International Association (PCMCIA). This organization is comprised of hundreds of manufacturers of memory cards and related peripheral equipment. By convention, the PCMCIA has determined that the spatial standard for all memory cards used in down-sized computers should be restricted to a rectangular space approximately 55 mm in width, 85 mm in length, and 5 mm in depth.

In keeping with the PCMCIA standards for memory cards, internal modem manufacturers have adopted the same spatial standards for use with their down-sized communications cards. By complying with the standards established by PCMCIA for memory cards, communications card manufacturers have assured themselves of compatibility and spatial conformity with computers utilizing the new PCMCIA standards.

The constraints imposed by this new PCMCIA standard have resulted in the development of "credit card" communications cards. Most of the components formerly housed within a modem are now contained within a credit card-sized device. Although many of the communication cards serve the functions of a modem, a similar card has been contemplated for use in LANs. Nonetheless, the problem will hereinafter be addressed in terms of the PCMCIA standard communications card.

Since the depth of a PCMCIA standard communications card is limited to 5 mm and the depth of a typical media connector, such as the RJ-11 type or 8-pin miniature modular plug, is approximately 8–12 mm, the typical media connector exceeds the depth restrictions imposed by the PCMCIA standards for internal computer components.

While many prior art devices have tried to solve the depth incompatibility problem between the PCMCIA standard communications card and the media connector, a "pop-out" or sliding interface device has emerged as a popular solution. The pop-out interface device, known commonly as the XJACK® initially produced by MEGAHERTZ Corp., now owned by 3 Com Corp., solves many of the interface problems posed by prior art devices. Such solved problems include, but are not limited to: (i) the elimination of carrying along an extra interfacing device compatible with both the media connector and the PCMCIA communications card; (ii) the elimination of ensuring a DAA in the interfacing device is compatible with the computer; (iii) the elimination of physical interference between adjacent PCMCIA communication cards in adjacent slots when the PCMCIA communication card has an enlarged portion thereof larger than the conventional 5 mm thickness; (iv) the elimination of potential breakage of the interface connector when not in use; and (v) the elimination of protrusions beyond the normal dimensions of the computer so that the computer portfolio is more compatible with devices typically transporting laptop computers.

With reference to FIG. 1, a typical embodiment of a sliding interface device in the form of a conventional 5 mm thick PCMCIA-architecture style communications card for directly interfacing with a media connector is depicted generally as 20. The communications card 29 defining the interface device 20 has a retractable access portion 22 and a fixed portion 24.

The fixed portion 24 is in electrical communication with a computer (not shown) by means of electronic circuitry connected on a printed circuit board (PCB) housed internally within the communications card 29. For brevity, fixed portion 24 may sometimes be referred to as the PCB 24 although the fixed portion includes more than just the PCB and electronic circuitry. The retractable access portion 22 is in electrical communication with the fixed portion 24 through a flexible printed circuit board 30. During use, in means well known in the art, the retractable access portion 22 slides in and out of a slot 32 formed within the PCB 24. The retractable access portion 22 is urged out of the slot 32 by a spring 34 biased, in a direction external to the computer housing, by a ledge 36 connected to the PCB 24. Although not shown, the computer housing during use is substantially parallel to an edge 37 of the communications card 29. A limiting notch 42 engaged by a biased lever 40 is used to restrict the travel distance of the interface device to a predetermined distance when the retractable access portion is urged in a direction external to the computer housing by the spring 34. After use, a retention notch 38 in combination with the biased lever 40 is used to retain the retractable access portion 22 within the housing of the computer.

An aperture 44 having a plurality of walls 46 is formed within the retractable access portion 22. The aperture 44 is so sized and shaped as to be capable of receiving a physical/electrical media connector. Formed within aperture 44 by means of walls 46 is a broad retention clip groove 48, a narrow retention clip groove 50, and a retention ridge 52. These structures within aperture 44 provide for the retention of a connector pin block of a physical/electrical media connector. A guide track 54 is formed within communications card 29 protruding upwardly from the bottom of communications card 29. Guide track 54 is interengaged with a corresponding guide groove formed in the bottom of retractable access portion 22.

When a user desires to connect a telephone line to the communications card, biased lever 40 is manipulated out of retention notch 38. As retractable access portion 22 is released from the grip of biased lever 40, tension applied by spring 34 urges retractable access portion 22 out of slot 32. The progress of retractable access portion 22 is guided by guide track 54 and is halted when biased lever 40 engages limiting notch 42. A user then inserts a physical/electrical media connector into aperture 44 to provide an electrical connection between communications card 29 and the telephone line. When a user no longer desires to access the retractable access portion 22, the user merely presses retractable access portion 22 back within the confines of the computer housing until the retention notch 38 is engaged by biased lever 40.

Although extremely effective as a device suitable for physically and electrically interfacing a PCMCIA communications card and a media connector, the sliding interface connectors are limited by certain inherent constraints. For example, the retractable access portion 22 is typically manufactured out of a dielectric material such as a plastic that inherently provides electrical insulation between the media connector and the communication card 29. As media connectors tend to transmit higher rate data, media connectors are increasingly more reliant upon the shielding properties available through the use of shielded cables that are terminated by media connectors. Shielded media connectors typically are comprised of a traditional media connector augmented by a peripheral shielding jacket physically located about the external portion of the media connector and, additionally, electrically coupled to the shielding conductor of the shielded media cable. As those familiar with the art of shielding appreciate, effective shielding requires an electrically conductive path from the cable shielding to a reference ground point. Since prior art attempts do not facilitate the electrical connection of the shield associated with the shielded cable to a common ground reference point, the prior art implementations do not facilitate the available benefits of employing the properties of shielded communication channels.

Accordingly, it would be an advance to provide an improved electrical connection between the media connector and the communications card that accommodates the substantial benefits of shielded cable designs.

SUMMARY AND OBJECTS OF THE INVENTION

It is, therefore, an object of the present invention to provide an improved electrical connector for use between a shielded media connector and a communications card that provides electrical conduction for the shield of a shielded cable to a ground reference.

It is another object of the present invention to provide an improved electrical connector for use between a shielded media connector and a communications card that economically provides a connecting solution for shielded cable interconnections.

It is a further object of the present invention to provide an improved electrical connector for use between a shielded media connector and a communications card that requires minimal design changes to accommodate higher data rate interconnects.

In accordance with the invention as embodied and broadly described herein, the foregoing and other objectives are achieved by providing an improved electrical connector in a communications card for use in interfacing between a shielded media connector and a downsized computer. In a preferred embodiment, the communications card comprises a retractable access portion and a fixed portion. The retractable access portion has an aperture formed therein configured to receive the shielded media connector. A conductive flexible printed circuit board having a first and a second end mates with both the retractable access portion and the fixed portion. The first end makes electrical contact with the media connector while, simultaneously, the second end makes electrical contact with the fixed portion. A conductive shielding terminal having a first and a second end is located with the first end located adjacent to the aperture to electrically contact the shielding jacket of the shielded media connector. The second end of the conductive shielding terminal extends longitudinally with the retractable access portion to provide electrical contact with a ground path contact on the fixed portion of the communications card.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

In accordance with the present invention, an improved electrical connector is provided for use between a shielded media connector and a communications card in a computer system. It is a feature of the present invention to facilitate the electrical conduction of a ground path between a shielded media connector and a grounded point on the computer.

As used herein, a "PCMCIA communications card" or "communications card" refers to a communications card falling within the memory card parameters defined by the Personal Computer Memory Card International Association having a thickness less than the thickness of a miniature modular jack physical/electrical shielded media connector.

Accordingly, a communications card also refers to PCMCIA architecture modem cards, PCMCIA architecture network cards, such as a LAN, or equivalents thereof.

As used herein, a "miniature modular jack physical/electrical shielded media connector" or "shielded media connector" connotes a media connector such as those connectors having physical attributes described in F.C.C. parts 15 and 68, expressly incorporated herein by reference as well as the Category 5 grounding standards. Specific media connectors such as a RJ-11 or a RJ-45 are merely references to a specific exemplary media connector falling within the broader parameters of the term "shielded media connector" and should not be used to limit the scope of the present invention to specific connectors.

Figure 1:
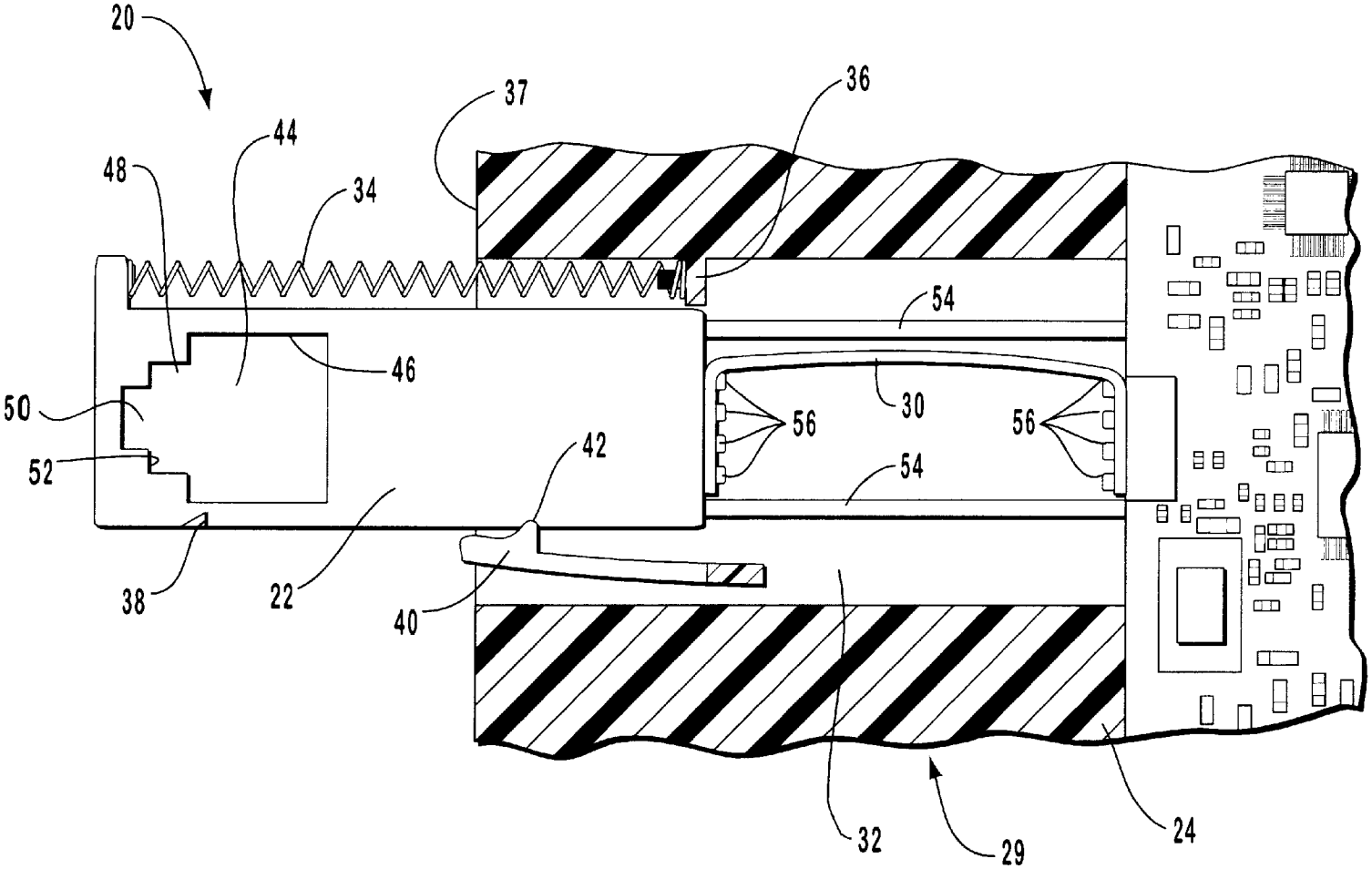
FIG. 1 (PRIOR ART)
FIG. 1 is a plan view of a prior art sliding interface device for interconnecting a non-shielded media connector with a communications card.
Figure 2:
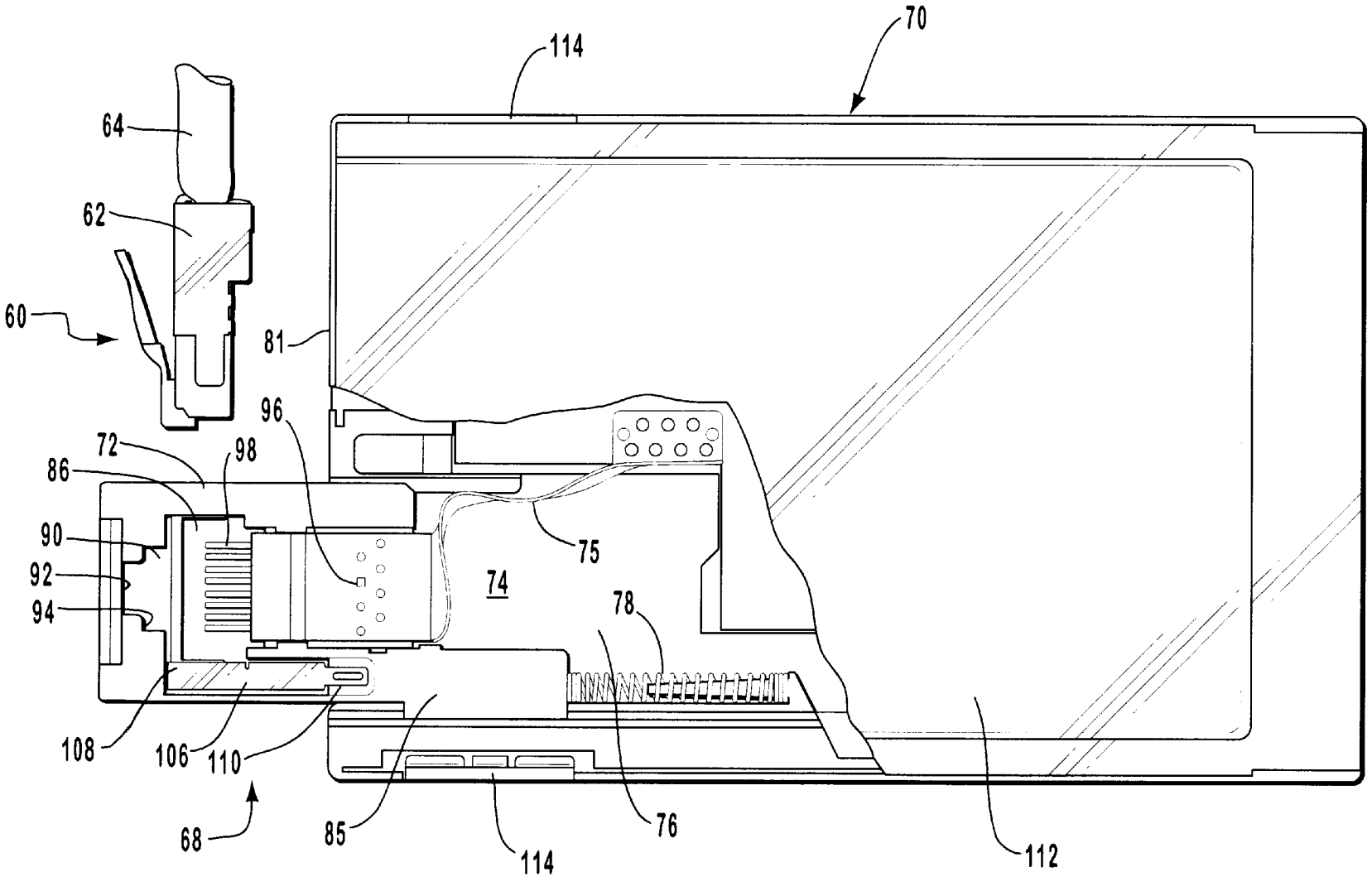
FIG. 2 is a plan view of a communications card, in accordance with the present invention, having a conductive shielding terminal for electrically connecting a shielded media connector with the communications card.

With reference to FIG. 2, a sliding interface electrical connector in accordance with the present invention for ultimately providing electrical communication between a shielded media connector 60 and a computer (not shown) is depicted generally as 68. Shielded media connector 60 includes a shielding jacket 62 comprised of an electrically conductive material that is further electrically connected to the shielding layer or conductor of shielded cable 64. Shielded media connector 60, in the preferred embodiment, is compliant with several standards including PC Card 97 Cardbus requirements, Category 5 grounding standard and FCC part 15.

The electrical connector 68 is defined by a communications card 70 having a retractable access portion 72 and a fixed portion 74. The fixed portion 74 is in electrical communication with the computer by means of electronic circuitry connected on a printed circuit board (PCB) housed internally within the communications card 70. As used herein, fixed portion 74 shall refer to the generally stationary features internal to the communications card. Such features include, but are not limited to, the PCB, the electronic circuitry thereon, the mechanical spacers and connectors used to physically connect the PCB to the communications card. The retractable access portion 72 is in electrical communication with fixed portion 74 through a flexible printed circuit board 75.

During use, in means well known in the art, the retractable access portion 72 slides in and out of a slot 76 formed within the fixed portion 74. The retractable portion 72 is urged out of the slot 76 by a spring 78 biased, in a direction external to the computer housing. Although not shown, the computer housing during use is substantially parallel to an edge 81 of the communications card 70. A limiting notch engaged by a biased lever in assembly 85 is used to restrict the travel distance of the retractable access portion 72 to a predetermined distance when the retractable access portion is urged in a direction external to the computer housing by the spring 78. After use, a retention notch also within assembly in combination with the biased lever is used to retain the retractable access portion 72 within the housing of the computer and the housing of the communications card.

An aperture 86 having a plurality of walls 88 is formed within the retractable access portion 72. The aperture 86 is so sized and shaped as to be capable of receiving a media connector. Formed within aperture 86 by means of walls 88 is a broad retention clip groove 90, a narrow retention clip groove 92, and a retention ridge 94. These structures within aperture 86 provide for the retention of a connector pin block of a shielded media connector.

When a user desires to connect a shielded network or telephone line to the communications card, the biased lever is manipulated out of the retention notch. As retractable access portion 72 is released from the grip of the biased lever, tension applied by spring 78 urges retractable access portion 72 out of slot 76. The progress of retractable access portion 72 is guided by portions of the sliding interface and is halted when the biased lever engages the limiting notch within assembly 85. A user then inserts at least a portion of shielded media connector 60 into aperture 86 to provide an electrical connection between communications card 70 and the network or other shielded line. When a user no longer desires to access the retractable access portion 72, the user merely presses retractable access portion 72 back within the confines of the computer housing until the retention notch is engaged by the biased lever.

However, it should be appreciated that even further biasing means, aperture embodiments for accepting a media connector during use and retention means for stabilizing the media connector, for example, are contemplated within the scope of the present invention and are more fully described in U.S. Pat. Nos. 5,183,404, 5,336,099 and 5,338,210. All three of these patents are expressly incorporated herein by reference.

The electrical connector 68 comprises a pin block 96 for accommodating at least one conductive terminal or lead 98. In FIG. 2, eight conductive leads being in substantially parallel arrangement are illustrated. The conductive lead is preferably one singular conductive material that extends through pin block 96. Preferably, the conductive lead is inserted within and molded contiguously with the pin block 96 in a well known manufacturing technique often referred to as "insert molding."

The first end of the conductive lead 98 is for making electrical contact with the shielded media connector during use when the media connector is inserted into aperture 86. Preferably, the first end extends at least partially into the aperture 86 for electrically contacting the necessary conductors of the shielded media connector. The second end of the conductive lead 98 is interfacing with flexible printed circuit board 75 or other conductors for making electrical contact with the fixed portion 74.

The electrical connector 68 must further accommodate the shielding needs of the shielded media connector 60. To accommodate this need, a conductive shielding terminal 106 is fixed to the retractable access portion 72 of the communication card 70. The conductive shielding terminal 106 is placed adjacent to aperture 86 to facilitate the physical encountering and electrical conduction through contact with the shielding jacket 62 of shielded media connector 60. The conductive shielding terminal 106 is comprised of a conductive structure such as a metallic conductor for completing the circuit between the shielding jacket 62 and a ground path contact located within communications card 70.

The conductive shielding terminal 106 is further comprised of a first end 108 located adjacent to the aperture 86 of the retractable access portion 72, thereby providing a conductive end of the conductive shielding terminal 106 for encountering the shielding jacket 62 when shielded media connector 60 is engaged in the electrical connector 68. When a user places the shielded media connector 60 at least partially into the aperture 86, the first end 108 of the conductive shielding terminal 106 makes physical and electrical contact thereto. The shielding from shielded cable 64 is thereafter completed by a second end 110 of the conductive shielding terminal 106. The second end 110 facilitates electrical contact with a ground path contact located on the fixed portion 74 of communications card 70. In the preferred embodiment, the second end 110 of conductive shielding terminal 106 maintains a crimped or V-shaped spring profile for encountering and thereby providing electrical contact with a ground path contact of fixed portion 74.

In the preferred embodiment, the ground path contact assumes the form of a conductive metal cover characteristic of communications cards assuming a form factor consistent with the PCMCIA defined standard. The second end 110 of the conductive shielding terminal 106 physically touches and thereby electrically facilitates the grounding path necessary for the beneficial effects of shielding employed by shielded media connector 60. To further provide the grounding path from shielded cable 64 to the computer, the conductive metal cover 112, in the preferred embodiment, is in physical and electrical contact with an electrostatic discharge (ESD) clip 114. When communications card 70 is installed within a communications slot in a computer, the ESD clip 114 encounters a ground path contact within the communications card slot of the computer which thereby completes the electrical shielding path necessary for the beneficial effects of shielding technology.

Figure 3:
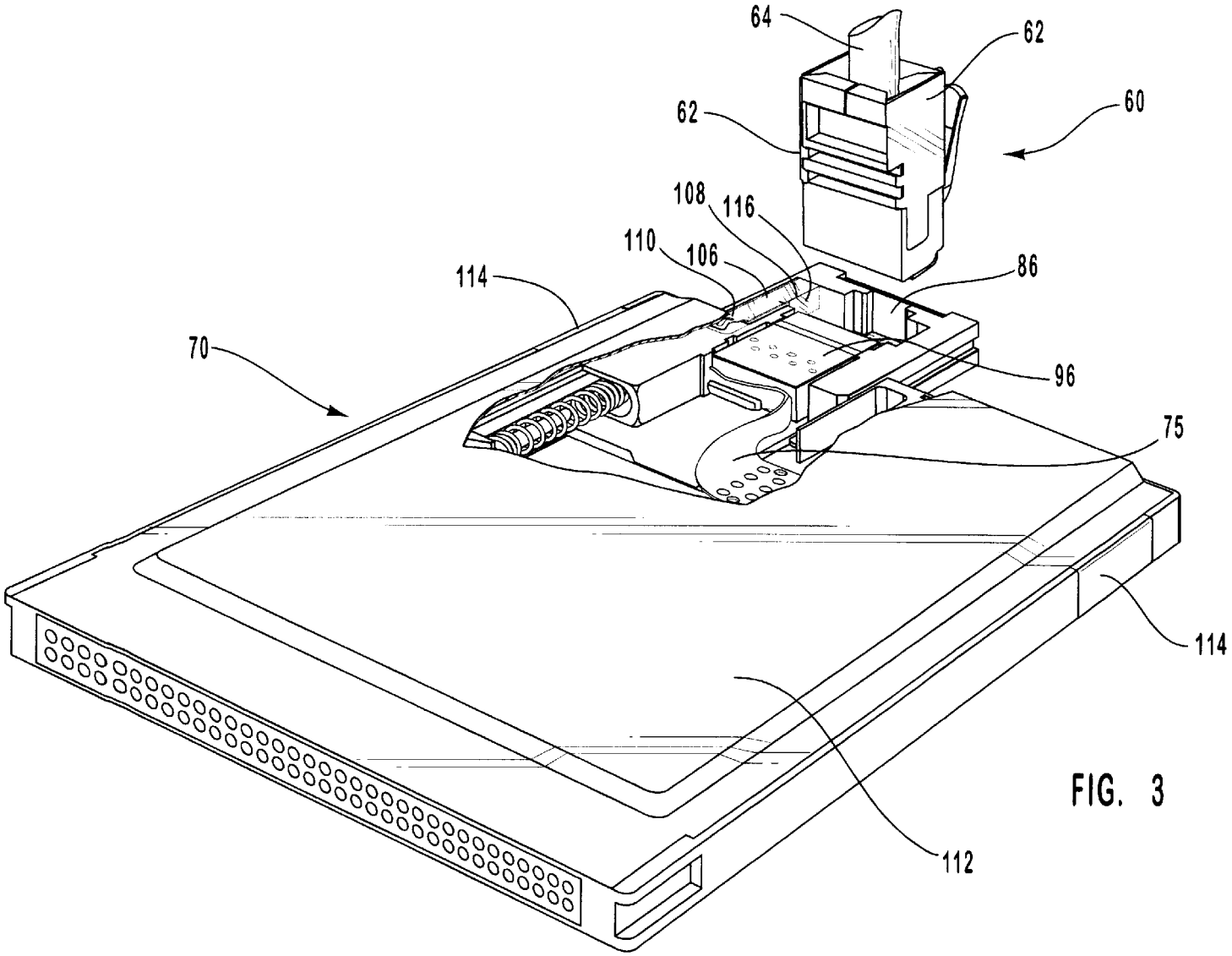
FIG. 3 is an exploded view of the connection system to facilitate shielding connectivity between a shielded media connector and a ground path contact, in accordance with a preferred embodiment of the present invention.

From FIG. 3, it should be appreciated that electrical connector 68 provides an additional terminal in the form of the conductive shielding terminal 106 for encountering and electrically completing the ground path for the shielding utilized in shielded media conductor 60. In the preferred embodiment, the conductive shielding terminal 106 is further comprised of a spring tab 116 located at the first end 108. The spring tab 116 extends down into aperture 86 for encountering the shielding jacket 62 of shielded media connector 60. Furthermore, in the preferred embodiment, the spring tab 116, when shielded media connector 60 is not inserted thereinto aperture 86, exhibits an acute angle with a wall forming aperture 86. Such an acute angle exhibits slight tension on shielded media connector 60 when inserted therein, thereby providing an affirmative contact with the shielding jacket 62 of shielded media connector 60.

The conductive shielding terminal 106, in the preferred embodiment, further exhibits at the second end 110, a V-spring formation for additionally providing affirmative contact with the ground path contact of the fixed portion of communications card 70. This V-shaped or curved terminal portion facilitates a sliding electrical contact between a conductive shielding terminal, or in the preferred embodiment the conductive metal cover 112, and the ground path contact of the computer. Those skilled in the art also appreciate that other forms of sliding contacts or other contacts providing electrical continuity when the retractable access portion of the communication card is extended may also be employed and are to be considered within the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A communications card for use in interfacing between a shielded media connector and a computer, said shielded media connector including a shielding jacket electrically connected with cable shielding associated with a shielded media cable yet electrically connected with said shielded media connector, said communications card comprising:

(a) a retractable access portion having an aperture formed therein configured to receive at least a portion of said shielded media connector;

(b) a fixed portion being capable of making electrical contact with said computer during use, said fixed portion further including a ground path contact for facilitating shielding of said shielded media connector to said computer; and (c) a conductive shielding terminal having a first end located adjacent to said aperture of said retractable access portion for making electrical contact with said shielding jacket of said shielded media connector during use, said conductive shielding terminal also having a second end for making electrical contact with said ground path contact to facilitate said shielding of said shielded media connector.

2. The communications card as recited in claim 1, wherein said first end of said conductive shielding terminal further comprises a spring tab projecting into said aperture of said retractable access portion for making electrical contact with said shielding jacket of said shielded media connector.

3. The communications card as recited in claim 1, wherein said first end of said conductive shielding terminal is physically located within said aperture of said retractable access portion thereby making conductive electrical contact with said shielding jacket of said shielded media connector when said shielded media connector is placed within said aperture of said retractable access portion.

4. The communications card as recited in claim 1, wherein said second end of said conductive shielding terminal further comprises a curved terminal portion thereof for facilitating a sliding electrical contact between said conductive shielding terminal and said ground path contact.

5. The communications card as recited in claim 1, wherein said fixed portion of said communications card assumes a PCMCIA form factor for compatible integration with said computer.

6. The communications card as recited in claim 5, wherein said fixed portion of said communications card is comprised of an electrically conductive cover forming said ground path contact thereon to facilitate shielding of said shielded media connector to said computer.

7. The communications card as recited in claim 6, wherein said fixed portion of said communications card further comprises an electrostatic discharge clip electrically connected to said electrically conductive cover to facilitate said ground path to said computer.

8. The communications card as recited in claim 1, wherein said aperture is configured to accept at least a portion of an RJ-45 media connector having said shielded jacket to form said ground path to said computer.

9. In a communications card having an electrical ground path contact connected to an electrically grounded portion of a computer and for use in interfacing between a shielded media connector having a shielding jacket electrically connected with cable shielding associated with said shielded media connector and said computer, a retractable connecting mechanism for electrically connecting said shielding jacket of said shielded media connector with said electrically grounded portion of said computer, said mechanism comprising:

(a) a retractable access portion having an aperture formed therein configured to receive at least a portion of said shielded media connector; and (b) a conductive shielding terminal having a first end located adjacent to said aperture of said retractable access portion for making electrical contact with said shielding jacket of said shielded media connector during use, said conductive shielding terminal also having a second end for making electrical contact with said ground path contact to facilitate said shielding of said shielded media connector.

10. The retractable connecting mechanism for electrically connecting said shielding jacket of said shielded media connector with said electrically grounded portion of said computer, as recited in claim 9, wherein said conductive shielding terminal further comprises a spring tab projecting into said aperture of said retractable access portion to make electrical contact with said shielding jacket of said shielded media connector.

11. The retractable connecting mechanism for electrically connecting said shielding jacket of said shielded media connector with said electrically grounded portion of said computer, as recited in claim 9, wherein said first end of said conductive shielding terminal is physically located within said aperture of said retractable access portion thereby making conductive electrical contact with said shielding jacket of said shielded media connector when said shielded media connector is placed within said aperture of said retractable access portion.

12. The retractable connecting mechanism for electrically connecting said shielding jacket of said shielded media connector with said electrically grounded portion of said computer, as recited in claim 9, wherein said second end of said conductive shielding terminal further comprises a curved terminal portion thereof for facilitating a sliding electrical contact between said conductive shielding terminal and said ground path contact.

13. The retractable connecting mechanism for electrically connecting said shielding jacket of said shielded media connector with said electrically grounded portion of said computer, as recited in claim 9, wherein said communications card assumes a PCMCIA form factor for compatible integration with said computer.

14. The retractable connecting mechanism for electrically connecting said shielding jacket of said shielded media connector with said electrically grounded portion of said computer, as recited in claim 13, wherein said second end of said conductive shielding terminal electrically interfaces to a metal cover forming said ground path contact of said communications card having said PCMCIA form factor.

15. The retractable connecting mechanism for electrically connecting said shielding jacket of said shielded media connector with said electrically grounded portion of said computer, as recited in claim 9, wherein said aperture is configured to accept at least a portion of an RJ-45 shielded media connector having said shielded jacket to form said ground path to said computer.

16. A communications connection system to facilitate connection of a shielded media connector with a computer, said shielded media connector including a shielding jacket electrically connected with cable shielding associated with a shielded media cable yet electrically connected with said shielded media connector, said connection system comprising:

(a) a communications card slot in a housing of said computer;

(b) a communications card capable of being received into said communications card slot of said housing, said communications card being comprised of:

(i) a retractable access portion having an aperture formed therein configured to receive at least a portion of said shielded media connector;

(ii) a fixed portion being capable of making electrical contact with said computer during use, said fixed portion further including a ground path contact for facilitating shielding of said shielded media connector to said computer; and (iii) a conductive shielding terminal having a first end located adjacent to said aperture of said retractable access portion for making electrical contact with said shielding jacket of said shielded media connector during use, said conductive shielding terminal also having a second end for making electrical contact with said ground path contact to facilitate said shielding of said shielded media connector.

17. The communications connection system as recited in claim 16, wherein said first end of said conductive shielding terminal further comprises a spring tab projecting into said aperture of said retractable access portion for making electrical contact with said shielding jacket of said shielded media connector.

18. The communications connection system as recited in claim 16, wherein said first end of said conductive shielding terminal is physically located within said aperture of said retractable access portion thereby making conductive electrical contact with said shielding jacket of said shielded media connector when said shielded media connector is placed within said aperture of said retractable access portion.

19. The communications connection system as recited in claim 16, wherein said second end of said conductive shielding terminal further comprises a curved terminal portion thereof for facilitating a sliding electrical contact between said conductive shielding terminal and said ground path contact.

20. The communications connection system as recited in claim 16, wherein said fixed portion of said communications card assumes a PCMCIA form factor for compatible integration with said computer.

21. The communications connection system as recited in claim 20, wherein said fixed portion of said communications card is comprised of an electrically conductive cover forming said ground path contact thereon to facilitate shielding of said shielded media connector to said computer.

22. The communications connection system as recited in claim 21, wherein said fixed portion of said communications card further comprises an electrostatic discharge clip electrically connected to said electrically conductive cover to facilitate said ground path to said computer.

23. The communications connection system as recited in claim 16, wherein said aperture is configured to accept at least a portion of a shielded RJ-45 media connector.

24. An apparatus for electrically connecting a shielded media cable to a ground path, said apparatus comprising:

a media cable having a shield;

a media connector having a shielding jacket in electrical communication with said shield of said media cable;

a communications card including a retractable access portion with an aperture sized and configured to receive at least a portion of said media connector and a fixed portion with a ground path configured to be electrically grounded; and a connecting member having a first end configured to be in electrical communication with said shielding jacket of said media connector and a second end in electrical communication with said ground path of said communications card to establish electrical communication between said shield of said media cable and said ground path.

25. The apparatus of claim 24, wherein said ground path of said communication card is configured to be electrically connected to a ground point of a computer.

26. A communications card for electrically connecting a media connector with a shield to a computer, said communications card comprising:

a fixed portion having a ground path configured to be electrically connected to the computer;

a retractable access portion with an aperture sized and configured to receive at least a portion of the media connector; and a grounding connector electrically coupled to said ground path of said fixed portion, said grounding connector sized and configured to electrically connect the shield of the media connector to said grounding path.

27. A mechanism attached to a communications card having an electrical ground path, said mechanism configured to electrically connect a shielded media connector to a ground path of a computer, said mechanism comprising:

a retractable access portion with an aperture sized and configured to receive at least a portion of the media connector; and a grounding connector having a first end located adjacent to said aperture of said retractable access portion for making electrical contact with a shielding jacket of the media connector and a second end for making electrical contact with the ground path of the communication card, said grounding connector configured to establish an electrical connection between the shielding jacket and the ground path of the computer.

* * * * *

UNITED STATES PATENT AND TRADEMARK OFFICE

CERTIFICATE OF CORRECTION

PATENT NO. : 5,989,042

DATED : Nov. 23, 1999

INVENTOR(S) : Thomas A. Johnson; Troy Garside

It is certified that error appears in the above-indentified patent and that said Letters Patent is hereby corrected as shown below:

Col. 7, lines 57 and 60, delete reference number "88"

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,989,042
DATED : November 23, 1999
INVENTOR(S) : Thomas A. Johnson; Troy Garside It is certified that error appears in the above-identified patent and that said Letters Patent is hereby corrected as shown below:

Title page, Item [73],
Assignee, change "23-3178, Santa Clara, Calif." to -- 3 COM Corp., S.L.C., UT. --

Signed and Sealed this

Fourth Day of September, 2001

*Attest:*

Nicholas P. Godici

NICHOLAS P. GODICI
*Acting Director of the United States Patent and Trademark Office*

*Attesting Officer*